US012582896B2

(12) United States Patent
Alarifi

(10) Patent No.: US 12,582,896 B2
(45) Date of Patent: Mar. 24, 2026

(54) SHIN GUARD MADE OF AUXETIC MATERIAL AND UNIT STRUCTURE THEREOF

(71) Applicant: Ibrahim M. Alarifi, Al-Majmaah (SA)

(72) Inventor: Ibrahim M. Alarifi, Al-Majmaah (SA)

( * ) Notice: Subject to any disclaimer, the term of this patent is extended or adjusted under 35 U.S.C. 154(b) by 276 days.

(21) Appl. No.: 17/722,538

(22) Filed: Apr. 18, 2022

(65) Prior Publication Data

US 2022/0233944 A1 Jul. 28, 2022

(51) Int. Cl.
*A63B 71/12* (2006.01)

(52) U.S. Cl.
CPC .. *A63B 71/1225* (2013.01); *A63B 2071/1258* (2013.01); *A63B 2209/00* (2013.01)

(58) Field of Classification Search
CPC ..... A63B 2071/1258; A63B 2209/00; B29C 44/357
See application file for complete search history.

(56) References Cited

U.S. PATENT DOCUMENTS 8,916,262 B2 * 12/2014 Hook ..... D02G 3/38 442/361

FOREIGN PATENT DOCUMENTS

CA 2822635 A1 * 2/2014 ..... A41B 1/08

* cited by examiner

*Primary Examiner* — Elizabeth M Imani
(74) *Attorney, Agent, or Firm* — Perilla Knox & Hildebrandt LLP; Kenneth A. Knox

(57) ABSTRACT

An article made from an auxetic material, the auxetic material having a plurality of unit structures joined together, is provided. The unit structure includes a first strut element, and a second strut element joined to the first strut element. Each of the first strut element and the second strut element have a predetermined thickness and width, wherein the first strut element being connected to the second strut element at a predetermined re-entrant angle (⊖). Further, the first strut element includes a top first strut element, and a bottom first strut element, and the second strut element includes a set of top second strut elements and a set of bottom second strut elements and wherein the strut element of the set of top second strut elements being connected to respective strut member of the set of bottom second strut elements.

1 Claim, 13 Drawing Sheets

SHIN GUARD MADE OF AUXETIC MATERIAL AND UNIT STRUCTURE THEREOF

TECHNICAL FIELD

The present disclosure generally relates to auxetic materials, particularly to a shin guard made of auxetic material and a unit structure thereof.

BACKGROUND

In materials science and solid mechanics, Poisson's ratio is a measure of the Poisson effect, which is the deformation (expansion or contraction) of material in directions perpendicular to the specific direction of loading. The value of Poisson's ratio is the negative of the ratio of transverse strain to axial strain. Most conventional materials have Poisson's ratio values ranging between 0.0 and 0.5. For soft materials, such as rubber, where the bulk modulus is much higher than the shear modulus, Poisson's ratio is near 0.5.

However, advancements in the field of material science and solid mechanics have brought about various materials that behave differently. For example, auxetics are structures or materials with a negative Poisson's ratio. This means that, when stretched, auxetics are structures or materials that tend to become thicker perpendicular to the applied force. This occurs primarily due to their particular internal structure and how it deforms when the sample is uniaxially loaded. Auxetics can be single molecules, crystals, or a particular structure of macroscopic matter. Such materials and structures are expected to have mechanical properties such as high energy absorption and fracture resistance. Therefore auxetic materials have been found to be useful in applications such as body armor, packing material, knee and elbow pads, robust shock-absorbing material, and sponge mops.

However, there are various disadvantages associated with the hitherto existing structures of auxetic material and various challenges associated with usage of the auxetic material, which sometimes tend to make usage and application of auxetic material suitable.

BRIEF SUMMARY

In view of the preceding disadvantages inherent in the prior art, the present disclosure's general purpose is to provide a unit structure of auxetic materials that includes all advantages of the prior art, and yes overcomes the drawbacks inherent in the prior art.

An object of the present disclosure is to provide a novel unit structure of the auxetic material.

Another object of the present disclosure is to provide a protective article used in sports equipment with a novel unit structure.

Another object of the present disclosure is to provide a shin guard having a novel unit structure of the auxetic material.

To achieve the above objects, in an aspect of the present disclosure, an article made from an auxetic material, the auxetic material having a plurality of unit structures joined together, is provided. The unit structure includes a first strut element, and a second strut element joined to the first strut element. Each of the first strut element and the second strut element has a predetermined thickness and width. The first strut element is connected to the second strut element at a predetermined re-entrant angle (⊖). Further, the first strut element includes a top first strut element, and a bottom first strut element, and the second strut element includes a set of top second strut elements and a set of bottom second strut elements and wherein the strut element of the set of top second strut elements being connected to respective strut member of the set of bottom second strut elements.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION

For a thorough understanding of the present disclosure, reference is to be made to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

The present disclosure provides an article made from an auxetic material, the auxetic material having a plurality of unit structures joined together. The unit structure includes a first strut element, and a second strut element joined to the first strut element. Each of the first strut element and the second strut element has a predetermined thickness and width. The first strut element is connected to the second strut element at a predetermined re-entrant angle (⊖). Further, the first strut element includes a top first strut element, and a bottom first strut element, and the second strut element includes a set of top second strut elements and a set of bottom second strut elements and wherein the strut element of the set of top second strut elements being connected to respective strut member of the set of bottom second strut elements.

Figure 1:
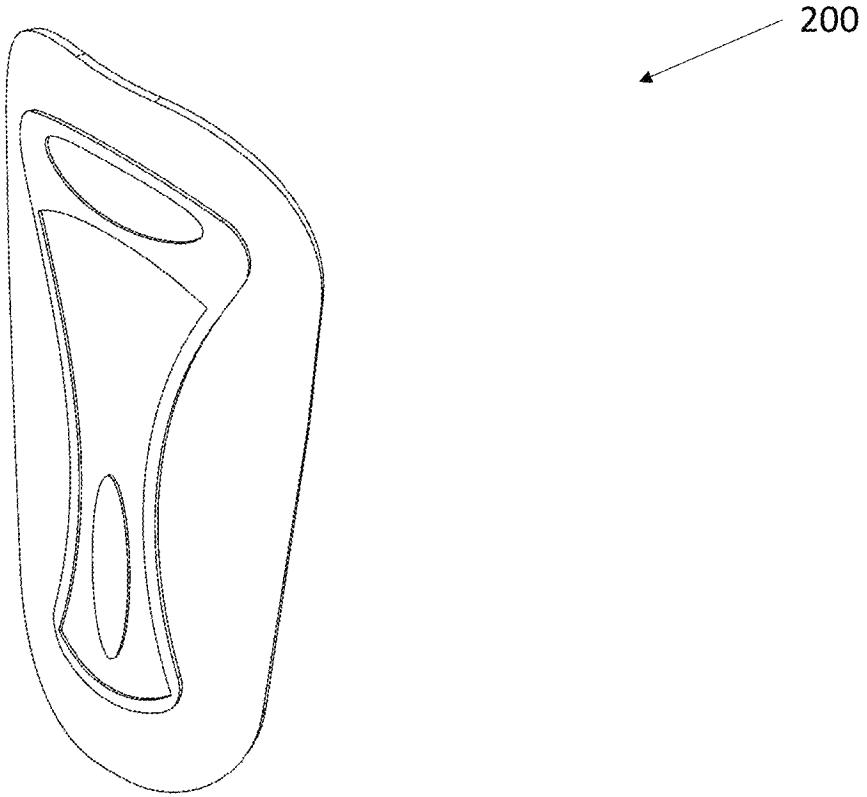
FIG. 1 illustrates a perspective view of a protective sports equipment, in accordance with an embodiment of the present disclosure.

Referring now to FIG. 1, a perspective view of a sports equipment (200) is illustrated according to an embodiment of the present disclosure. In an example, as illustrated, the sports equipment may be a shin guard. In alternative embodiments of the present disclosure, the sports equipment may be a helmet, a shoe, or any other protective or non-protective equipment, or part thereof.

Figure 2:
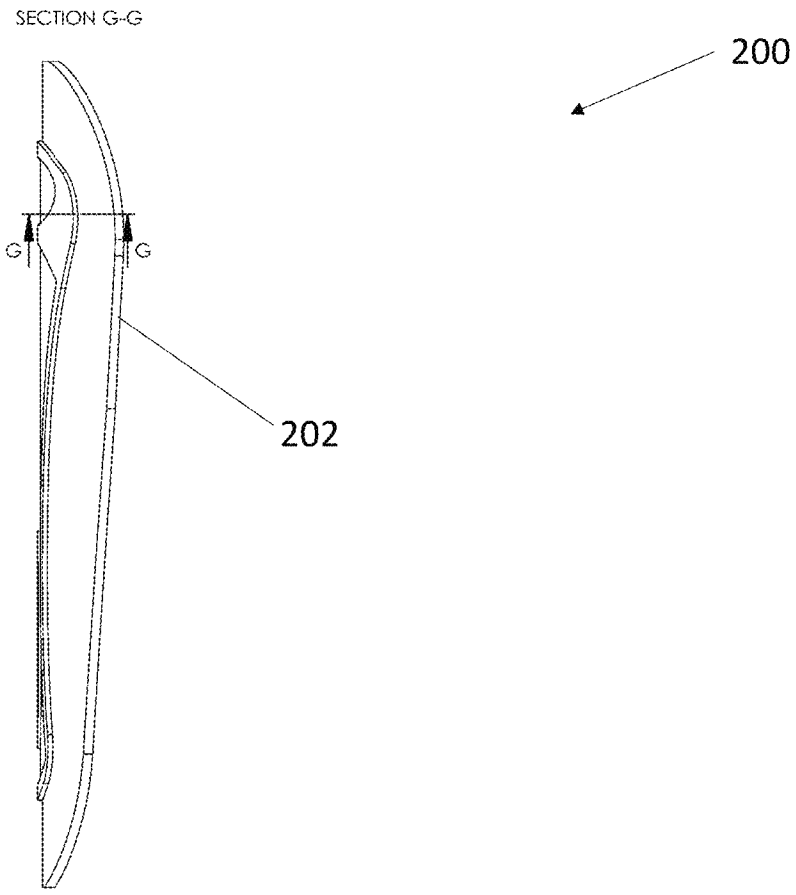
FIG. 2 illustrates a side view of the protective sport equipment as shown in FIG. 1, in accordance with an embodiment of the present disclosure.
Figure 3:
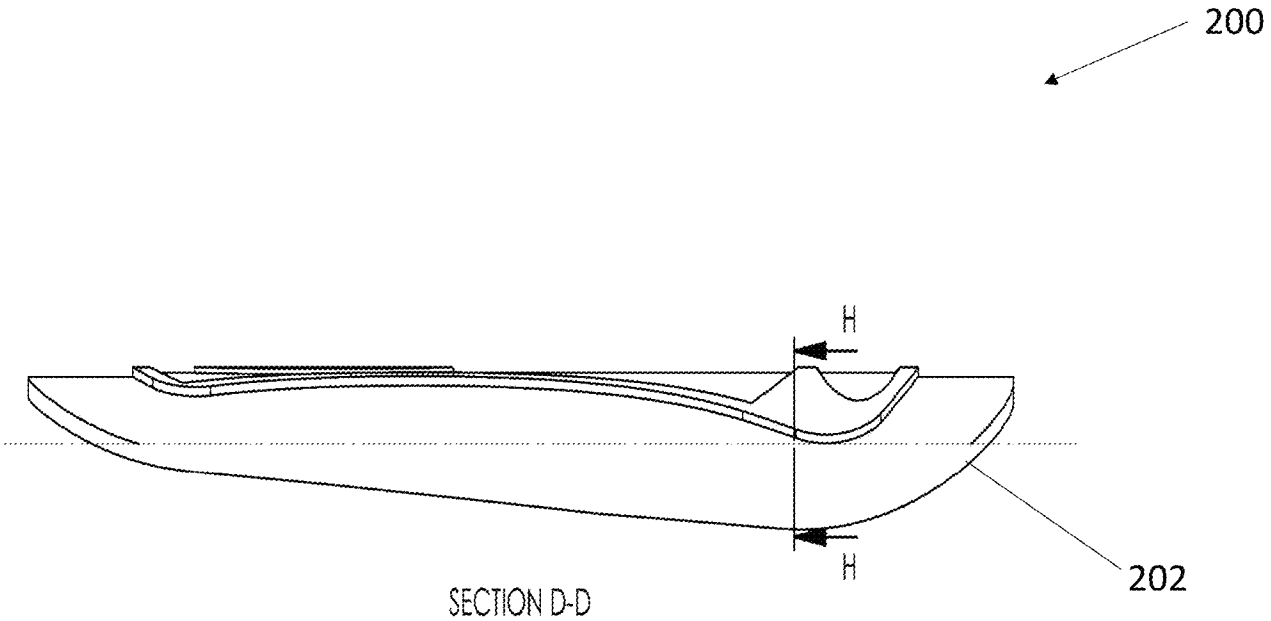
FIG. 3 illustrates another side view of the protective sports equipment as shown in FIG. 1, in accordance with an embodiment of the present disclosure.
Figure 4:
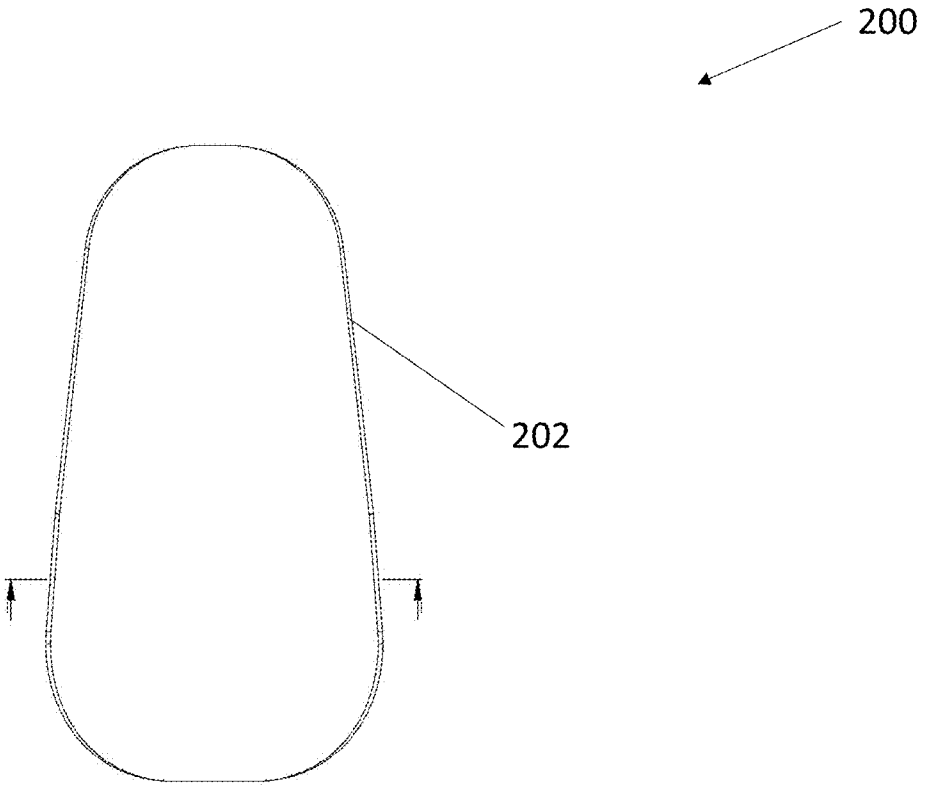
FIG. 4 illustrates another rear side view of the protective sports equipment as shown in FIG. 1, in accordance with an embodiment of the present disclosure.
Figure 5:
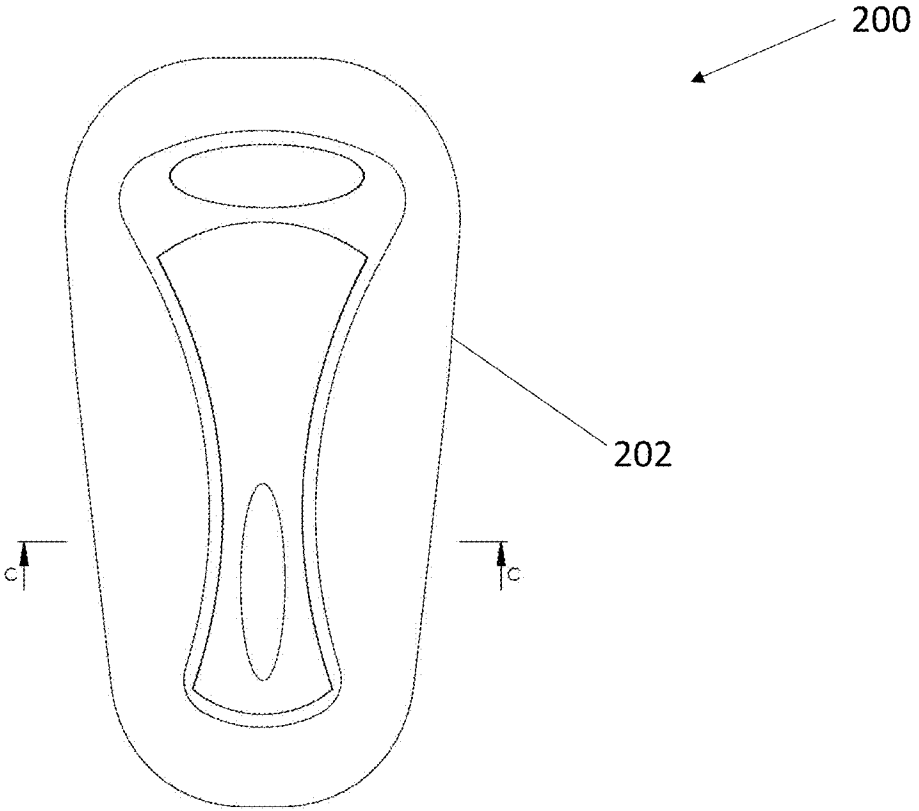
FIG. 5 illustrates another front view of the protective sports equipment as shown in FIG. 1, in accordance with an embodiment of the present disclosure.
Figure 6:
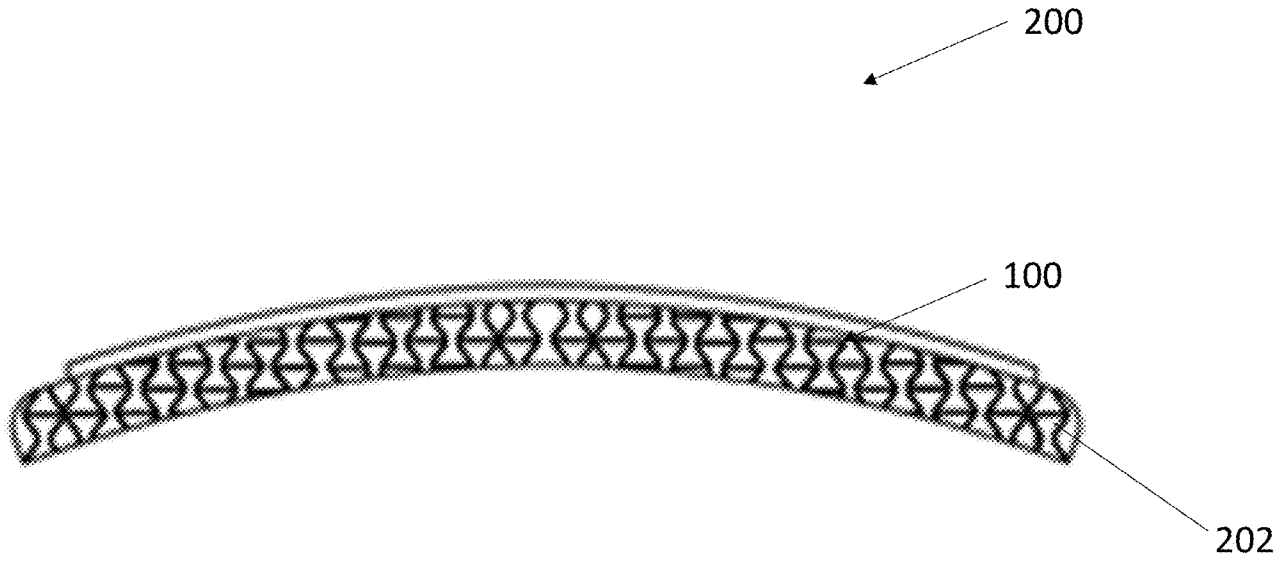
FIG. 6 illustrates a sectional view of the protective sports equipment as shown in FIG. 1, in accordance with an embodiment of the present disclosure.
Figure 7:
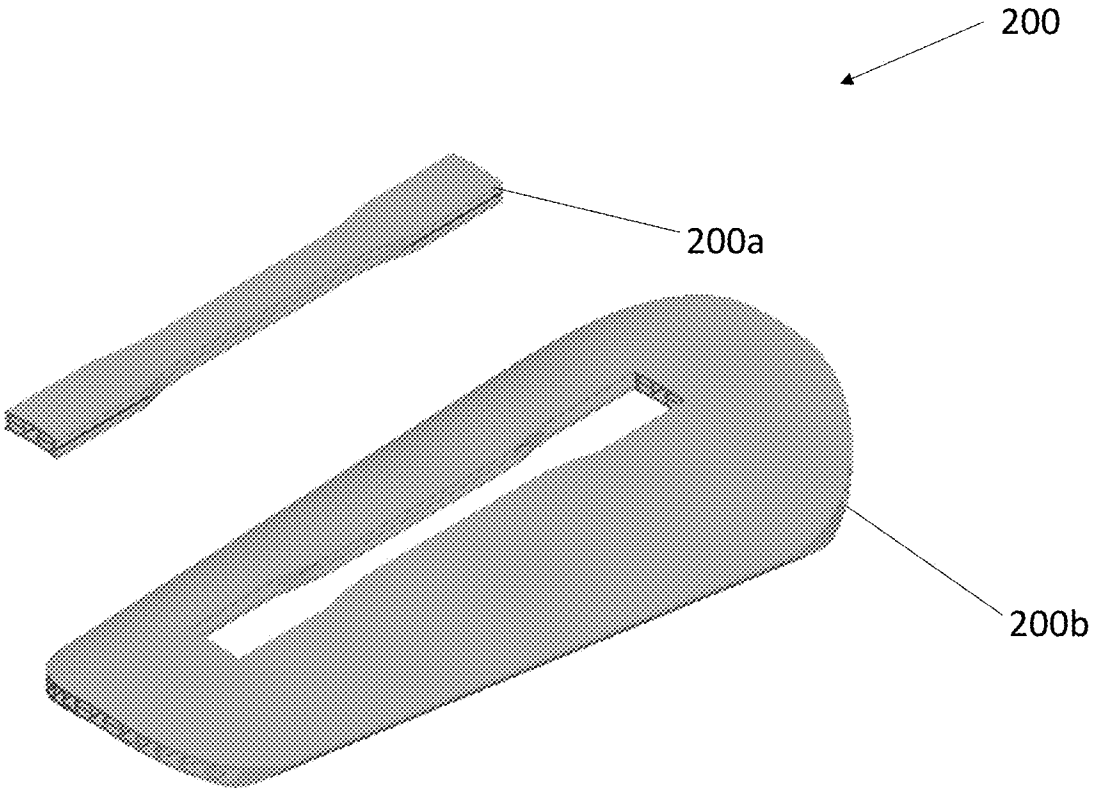
FIG. 7 illustrates a perspective view of the protective sports equipment as shown in FIG. 1, in accordance with an embodiment of the present disclosure.

FIG. 2, and FIG. 3, illustrate side views of the sports equipment (200), in accordance with an embodiment of the present disclosure. FIG. 4 and FIG. 5, illustrate the front and rear views of the sports equipment (200), in accordance with an embodiment of the present disclosure. On the other hand, FIG. 7, illustrates an exploded perspective view of the sports equipment. As illustrated in FIG. 7, the sports equipment (200) may be an assembly of multiple parts, namely an insert (200*a*) and an outer body (200*b*). Alternatively, the sports equipment (200) may be composed of a single part.

The sports equipment (200) as illustrated in any of these figures, is composed of an auxetic material (202). In examples where the sports equipment (200) is composed of multiple parts, as illustrated in FIG. 7, each of the said parts may be composed of the auxetic material (202).

The auxetic material (202) is made up of a plurality of singular unit structures (100) joined together. Each of the unit structures (100) may have an identical profile and may be joined together using various means, to form the auxetic material (202) that can be transformed into the required shape, i.e., the shape of the desired sports equipment, such as a shin guard.

Figure 8:
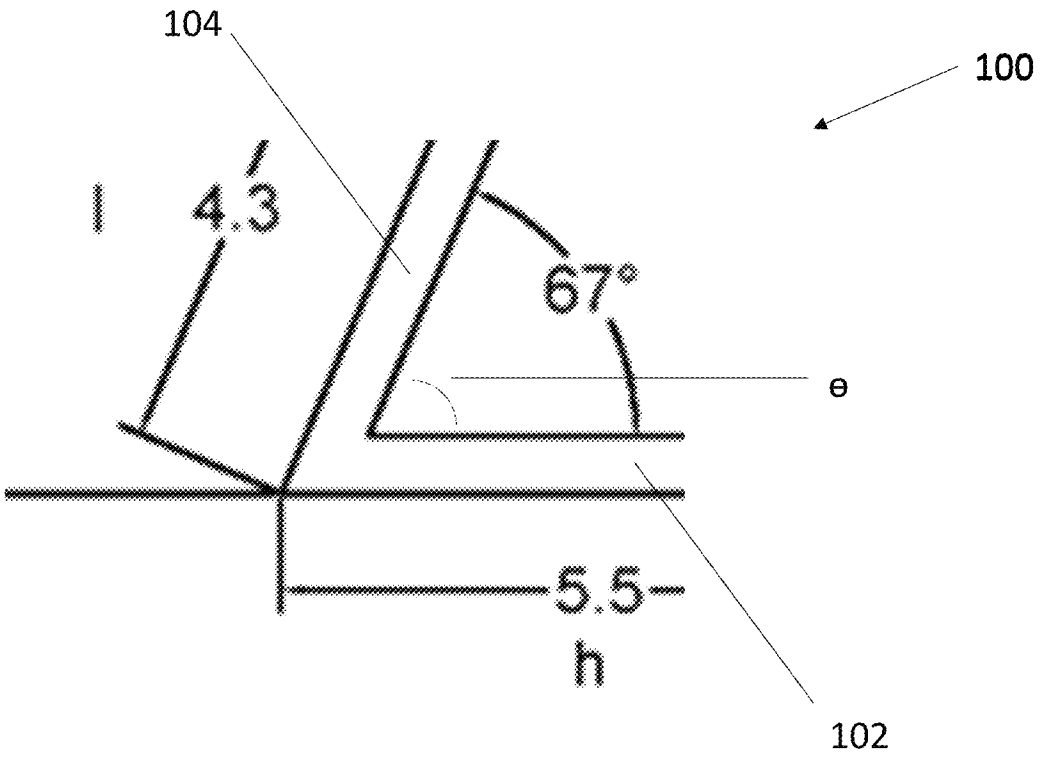
FIG. 8 illustrates a view of the unit structure of the auxetic material.

As shown in FIG. 8, the unit structures (100) include a first strut element (102); and a second strut element (104). The second strut element (104) may be joined to the first strut element (102) at a predetermined re-entrant angle (⊖). In an example, the predetermined re-entrant angle (⊖) is 67 degrees. Each of the first strut element (102) and the second strut element (104) have a predetermined thickness. Further, each of the first strut element (102) and the second strut element (104) have a predetermined width.

Figure 9:
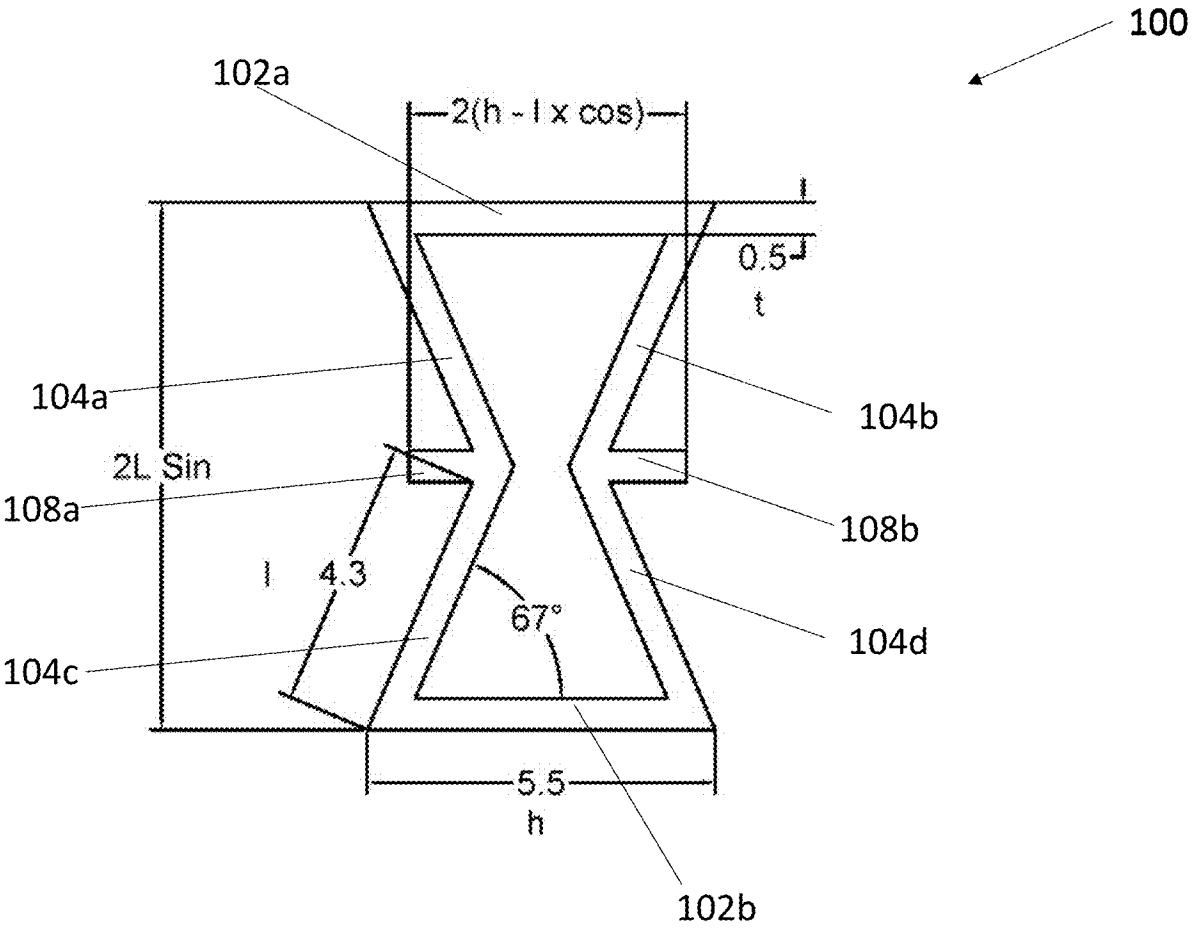
FIG. 9 illustrates a close-up view of a portion of a unit structure of the auxetic material.

As shown in FIG. 9, the unit structure (100) has the first strut element (102) which includes a top first strut element (102*a*), and a bottom first strut element (102*b*). Likewise, the second strut element (104) includes a set of top second strut elements (104*a*, 104*b*) and a set of bottom second strut elements (104*c*, 104*d*). As illustrated, the set of top second strut elements (104*a*, 104*b*) is connected to respective strut members of the set of bottom second strut elements (104*c*, 104*d*).

Further, the set of top second strut elements (104*a*, 104*b*) extends downwardly from opposite ends of the top first strut element (102*a*) at the predetermined re-entrant angle (⊖). In the same but in symmetric opposite manner, the set of bottom second strut elements (104*c*, 104*d*) extend upwardly from opposite ends of the bottom first strut element (102*b*) at the predetermined re-entrant angle (⊖).

In an embodiment, the predetermined re-entrant angle (⊖) ranges between 65 degrees to 70 degrees. For example, the predetermined re-entrant angle (⊖) is 67 degrees.

In an embodiment, both vertical struts (i.e., first strut element (102)) and oblique struts (i.e., second strut element (104)) may have the same square cross-section. For example, both vertical struts (i.e., first strut element (102)) and oblique struts (i.e., second strut element (104)) may have the same square cross-section 't.' In an example, the cross-section of vertical struts, and the oblique struts are about 0.5–/+0.01.

The first strut element (102) has a predetermined length "h", and the second strut element (104) has a predetermined length "l." The top first strut element (102*a*), is separated from the bottom first strut element (102*b*) by twice of "l" times sin (⊖).

The predetermined length "h" of the first strut element (102) is greater than twice "l" times cos (⊖). The first strut element (102) has a predetermined width "t", wherein the predetermined width "t" is less than "l" times sin (⊖). The width of the vertical struts (1*t*), and the width of the oblique struts (1*l*) (2*t*).

In an embodiment, the predetermined length h of the first strut element (102) is greater than $$\frac{(1-\cos\theta)t}{\sin\theta}+2l\cos\theta.$$

As shown in FIG. 9, the unit structure (100) further comprising a set of opposite horizontals elements (108*a* 108*b*) extending opposite to each other from the junction of a set of top second strut elements (104*a*, 104*b*) and the set of bottom second strut elements (104*c*, 104*d*).

Various test results prove and establish the performance of the unit structure (100) of the present disclosure.

Figure 10:
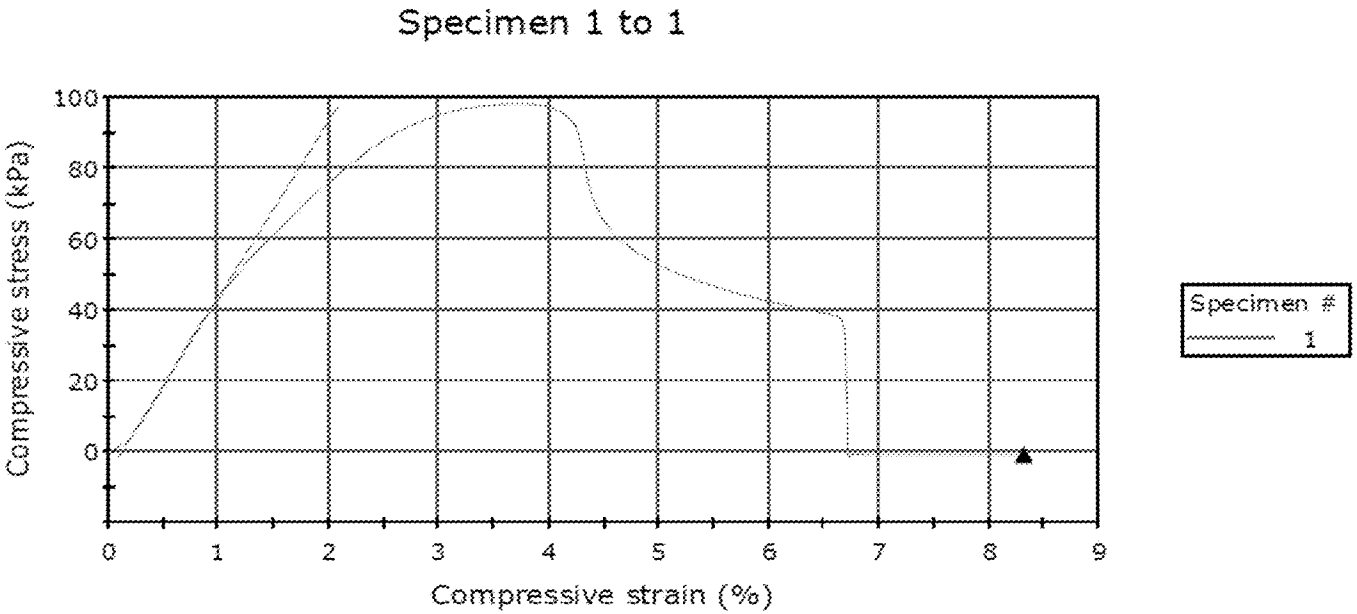
FIG. 10 illustrates a graph illustrating compressive testing on the auxetic material.

Compressive Testing Result: The energy absorption of reentrant structures was investigated, and it was concluded that under the same compressive strain, the reentrant structures absorbed more energy due to early densification, as illustrated in FIG. 10. The compressive test of the auxetic structure was the crushing performance of auxetic reentrants in terms of crushing stress and energy absorption.

Figure 11:
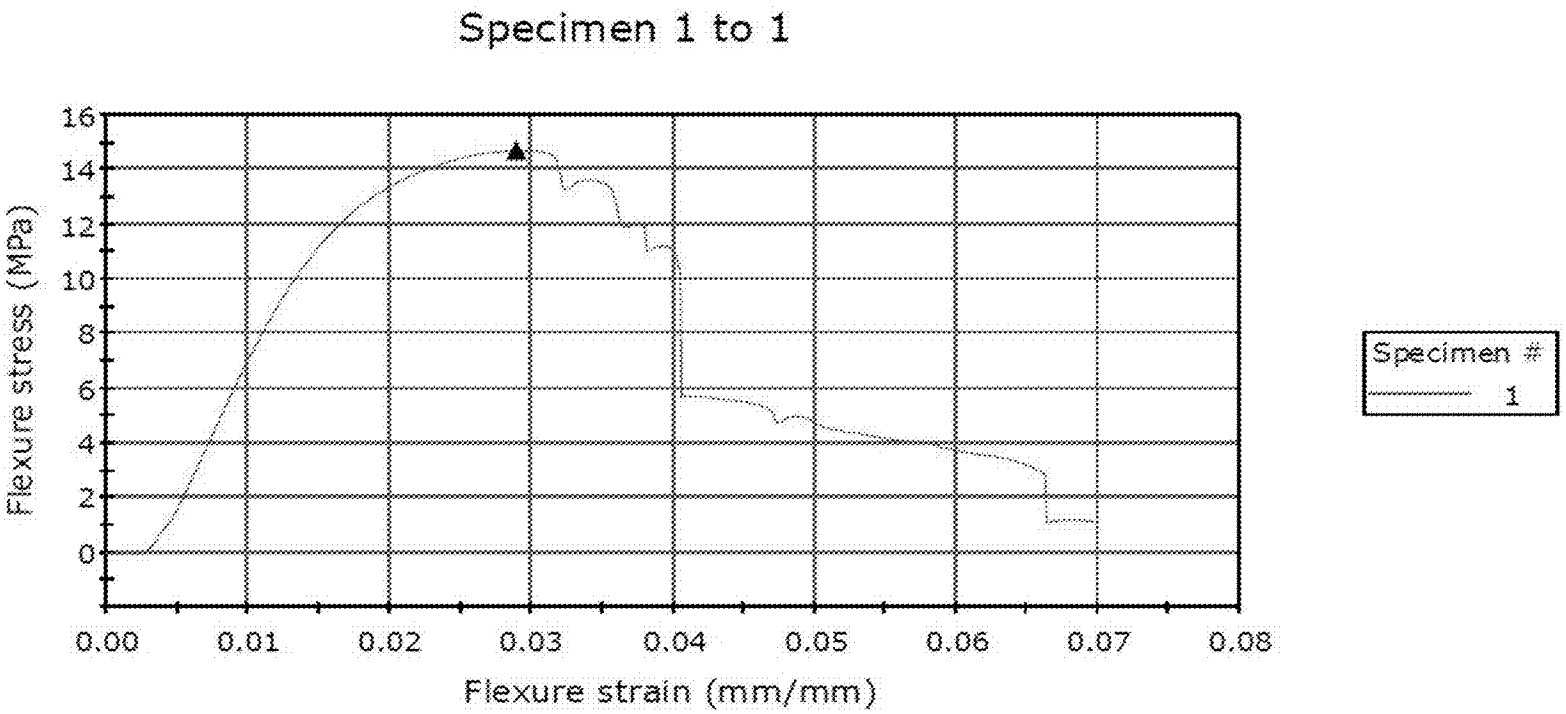
FIG. 11 illustrates a graph illustrating the bending test on the auxetic material.

3P Bending Test Result: The three-point bending flexural test provides results for the modulus of elasticity in bending, flexural stress, flexural strain, and the flexural stress-strain response of the material, refer to FIG. 11. This test is done on a universal testing machine (tensile testing machine or tensile tester) using a three-point or four-point bend fixture.

The major benefit of a three-point flexural test is the specimen preparation and testing convenience. However, this approach also has some disadvantages: the findings of the testing method are susceptible to specimen and loading geometry and strain rate.

In another embodiment of the present disclosure, a unit structure (100) of an auxetic material (202) is illustrated. The unit structure (100) comprises: a first strut element (102), includes a top first strut element (102*a*), and a bottom first strut element (102*b*), a second strut element (104) joined to the first strut element (102), the second strut element (104) includes a set of top second strut elements (104*a*, 104*b*) and a set of bottom second strut elements (104*c*, 104*d*), and wherein the strut element of the set of top second strut elements (104*a*, 104*b*) being connected to respective strut member of the set of bottom second strut elements (104*c*, 104*d*) the set of top second strut elements (104*a*, 104*b*) extend downwardly from opposite ends of the top first strut element (102*a*) at the predetermined re-entrant angle (⊖), and wherein the set of bottom second strut elements (104*c*, 104*d*) extend upwardly from opposite ends of the bottom first strut element (102*b*) at the predetermined re-entrant angle (⊖) wherein the predetermined re-entrant angle (⊖) ranges between 65 degrees to 70 degrees.

The first strut element (102) has a predetermined length "h", and the second strut element (104) has a predetermined length "l", wherein the top first strut element (102*a*), is separated from the bottom first strut element (102*b*) by twice of "l" sin (⊖). The predetermined length h of the first strut element (102) is greater than twice "l" times of cos (⊖).

The first strut element (102) has a predetermined width "t", wherein the predetermined width "t" is less than "l" times of sin (⊖).

Figure 8A:
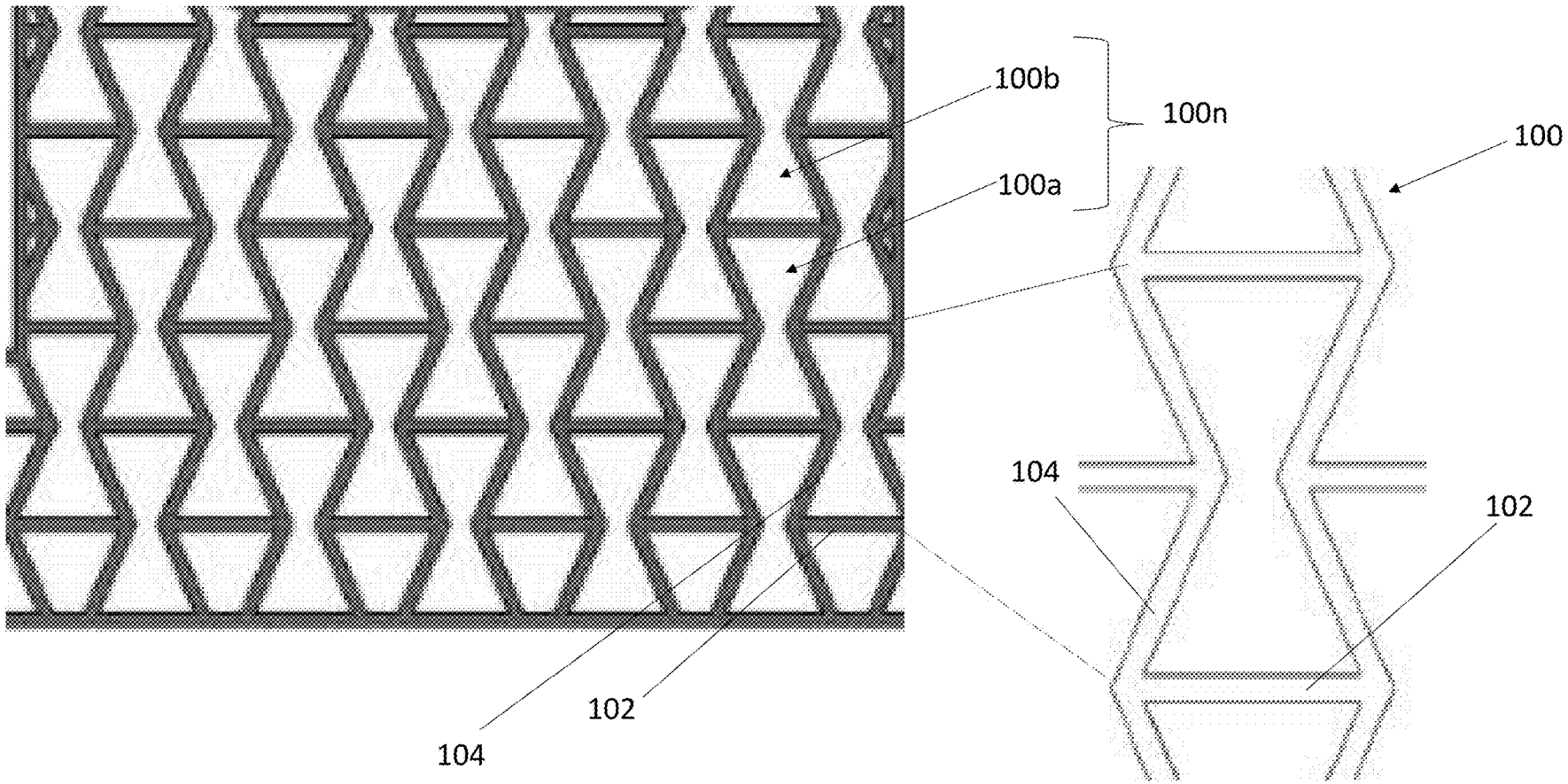
FIG. 8A illustrates a view of multiple unit structures joined together and an enlarged view of a single unit structure.

Referring now to FIG. 8A, the article (200) made from the auxetic material (202) in accordance with an embodiment includes a plurality of unit structures (100*n*). The plurality of unit structures (100*n*) has an array of unit structures identical to the first unit structure (100*a*). Such first unit structures are positioned adjacent to each other and connected to each other to form an array of unit structures.

In an embodiment, the plurality of unit structures (100*n*) comprise a first unit structure (100*a*), and one or more adjacent unit structures (100*b*) connected to the first unit structure (100*a*).

In an embodiment, the top first strut element (102*a*) of the first unit structure (100*a*) is the bottom first strut element (102*b*) of an upper positioned unit structure of the one or more adjacent unit structures (100*b*). Alternatively, the top first strut element (102*a*) of the first unit structure (100*a*) is connected to the bottom first strut element (102*b*) of the upper positioned unit structure of the one or more adjacent unit structures (100*b*). Likewise, the bottom first strut element (102*b*) of the first unit structure (100*a*) is the top first strut element (102*a*) of a bottom positioned unit structure of the one or more adjacent unit structures (100*b*). Alternatively, the bottom first strut element (102*b*) of the first unit structure (100*a*) is connected to the top first strut element (102*a*) of the bottom positioned unit structure of the one or more adjacent unit structures (100*b*).

Figure 9B:
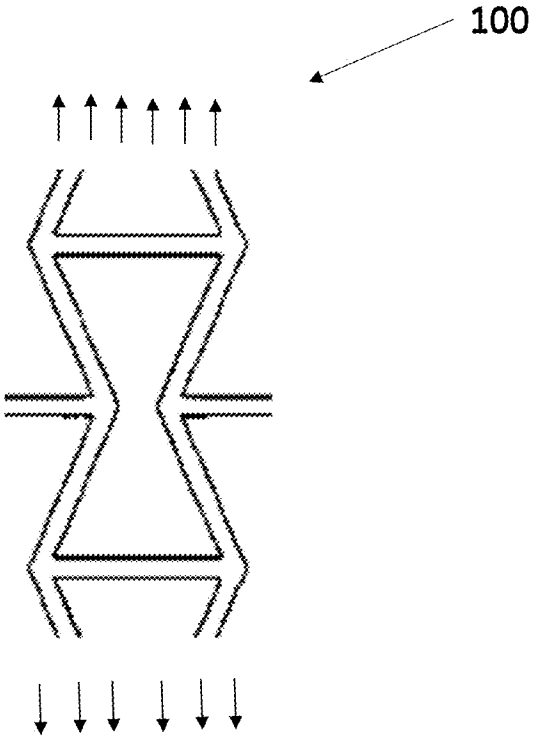
FIG. 9B illustrates another view of a portion of a unit structure of the auxetic material, under the application of a force.
Figure 9A:
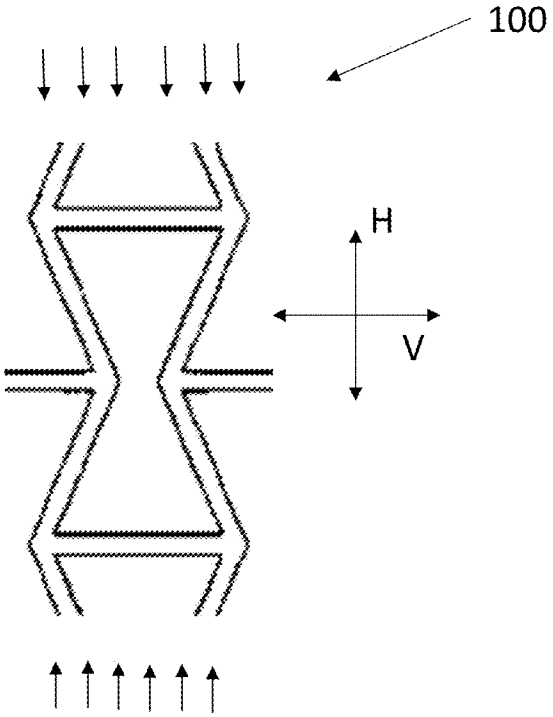
FIG. 9A illustrates a view of a portion of a unit structure of the auxetic material, under the application of a force.

Referring now to FIGS. 9A, and 9B, illustrating the auxetic material (202) under application of force, and resultant deformation thereon. Specifically, the FIGS. 9A and 9B illustrate the action of positive (+ive) and negative (−ive) force on the auxetic material (202), and its result. In particular, an application of compressive force on one or more of the top first strut element (102*a*) and the bottom first strut element (102*b*) causes compression between the set of top second strut elements (104*a*, 104*b*) and the set of bottom second strut elements (104*c*, 104*d*). For example, the application of compressive force, that is force along axis H, from the top first strut element (102*a*) towards the bottom first strut element (102*b*), causes compression, i.e., the movement towards each other whereby the top second strut element (104*a*) moving towards the top second strut element (104*b*), and the bottom second strut elements (104*c*) moving towards the bottom second strut elements (104*d*).

In the same manner the application of expanding force on one or more of the top first strut element (102*a*) and the bottom first strut element (102*b*) causes expansion between the set of top second strut elements (104*a*, 104*b*) and the set of bottom second strut elements (104*c*, 104*d*). For example, the application of expanding force, that is force along with axis V, from the top first strut element (102*a*) away from the bottom first strut element (102*b*), causes expansion, i.e., movement away from each other whereby the top second strut element (104*a*) moving away from the top second strut element (104*b*), and the bottom second strut elements (104*c*) moving away from the bottom second strut elements (104*d*).

As such, the deformation along the lateral (vertical) axis owing to Poisson's ratio under tensile axial (horizontal) stress for (a) a forced material and (b) a resultant auxetic material is illustrated.

In an example, the sports equipment (200), having the unit structure (100) of the auxetic material (202), may be manufactured using the 3D Printing technique. In such an example, the sports equipment (200) will be manufactured using the following materials and under the following parameters.

Filament: CarbonX™ CF-PETG

Chemical Name: Polyethylene Terephthalate Glycol Copolymer (PETG)

TABLE 1

| Printing Parameters | |
|---|---|
| Extruder Temp | 250 degrees |
| Bed Temp | 80 degrees |
| Printing Speed | 45 mm/s |
| Extruder Multiplier | 1 |
| Filament Diameter | 1.75 |
| Needle outer diameter | 0.4 |
| Needle inner diameter | 1.8 |
| Raster width | 0.25 |
| Layer height | 0.25 |
| First layer height | 0.25 |
| Fill density | 100% |
| Density | 1.34 g/cc |

It may herein be noted that an interlocking assembly approach for fabricating 3D auxetic cellular structures of the present disclosure has significant benefits over additive manufacturing.

During utilizing the article i.e., sports equipment made from the auxetic material having the described unit structure, the application of load or forces thereon, will cause the article to significantly absorb energy and expand while exhibiting negative Poisson's Ratio. Accordingly, the disclosed article, or any sports equipment having the disclosed unit structure, will have significant improvements and advantages over conventional materials.

More particularly, these dimensions with auxetic unit structures demonstrated more uniform deflection and bending compliance than other structures. Additionally, it was proved that the features of auxetic sandwich structures might be adjusted to meet the requirements of a particular design application by using alternative cell structure geometries. Additionally, it was discovered that additional three-dimensional cellular sandwich constructions might display great stiffness and strength, which is advantageous for possible applications.

Moreover, the auxetic sandwich panels displayed uniform stress and deformation distribution during bending. Bending experiments have shown that the auxetic sandwich panel mechanical characteristics could be customized across an extensive range by varying the Poisson's ratio. Additionally, the auxetic sandwich panels demonstrated exceptional bending resistance as compared to all other designs. Consequently, auxetic sandwich panels of the present disclosure have a great deal of promise for energy absorption applications in general.

What is claimed is:

1. An article made from an auxetic material, the auxetic material having a plurality of unit structures joined together, each unit structure comprising:

a first strut element, wherein the first strut element includes a top first strut element, and a bottom first strut element; and a second strut element joined to the first strut element, each of the first strut element and the second strut element have a predetermined thickness and width, wherein the second strut element includes a set of top second strut elements and a set of bottom second strut elements, wherein the strut element of the set of top second strut elements being connected to respective strut member of the set of bottom second strut elements, wherein the set of top second strut elements extend downwardly and inwardly toward each other from opposite ends of the top first strut element at the predetermined re-entrant angle (⊖), and wherein the set of bottom second strut elements extend upwardly and inwardly toward each other from opposite ends of the bottom first strut element at the predetermined re-entrant angle (⊖), wherein the first strut element being connected to the second strut element at a predetermined re-entrant angle (⊖), wherein the predetermined re-entrant angle (⊖) is 67 degrees;

wherein the first strut element and the second strut element have same square cross-section 't', wherein the cross-section of first strut element and the second strut element are about 0.5–/+0.01 units;

wherein the first strut element has a predetermined length "h", and the second strut element has a predetermined length "1", and wherein the top first strut element is separated from the bottom first strut element by twice of "1" times sin (⊖), wherein the predetermined length h of the first strut element is greater than $$\frac{(1-\cos\theta)t}{\sin\theta}+2l\cos\theta<h,$$

wherein the predetermined length "h" of the first strut element is greater than twice of "1" times cos (⊖), wherein the first strut element has a predetermined width "t", wherein the predetermined width "t" is less than "1" times sin (⊖), wherein 1 is about 4.3 units, and h is about 5.5 units, a set of opposite horizontals elements extending opposite to each other from the junction of the set of top second strut elements and the set of bottom second strut elements, said opposite horizontal elements extending orthogonally from said junction, and being co-linear along a horizontal axis, wherein the plurality of unit structures comprise a first unit structure, and one or more adjacent unit structures connected to the first unit structure, wherein the plurality of unit structures comprise a first unit structure, and one or more adjacent unit structures connected to the first unit structure, wherein the top first strut element of the first unit structure is the bottom first strut element of an upper positioned unit structure of the one or more adjacent unit structures, and the bottom first strut element of the first unit structure is the top first strut element of a bottom positioned unit structure of the one or more adjacent unit structures, such that the struts are structurally continuous across vertically adjacent unit structures;

wherein application of compressive force on one or more of the top first strut element and the bottom first strut element causes compression between the set of top second strut elements and the set of bottom second strut elements, whereby the top second strut element moves towards the top second strut element, and the bottom second strut elements moves towards the bottom second strut elements; and wherein application of expanding force on one or more of the top first strut element and the bottom first strut element causes expansion between the set of top second strut elements and the set of bottom second strut elements, whereby the top second strut element moves away from the top second strut element, and the bottom second strut elements moves away from the bottom second strut elements, wherein the article is a shin guard and the article comprises a carbon fiber reinforced polyethylene terephthalate glycol copolymer (CF-PETG) auxetic lattice having a density of about 1.34 g/cc, a fill density of about 100%, and a layer height of about 0.25 mm, and wherein the article exhibits an energy absorption of at least 5 J at 20% compressive strain under testing and a flexural modulus in the range of 100-200 MPa under a three-point bending test.

* * * * *